US007958703B2

(12) United States Patent
Miota et al.

(10) Patent No.: US 7,958,703 B2
(45) Date of Patent: Jun. 14, 2011

(54) CLOSURE SYSTEM WITH ORIENTATION AND REMOVAL CAPABILITY

(75) Inventors: Margaret M. Miota, Eagle, WI (US); Alan P. Hickok, Waukesha, WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 12/587,441

(22) Filed: Oct. 7, 2009

(65) Prior Publication Data

US 2010/0024197 A1 Feb. 4, 2010

Related U.S. Application Data

(62) Division of application No. 11/450,531, filed on Jun. 9, 2006, now Pat. No. 7,621,413.

(51) Int. Cl.
*B65B 7/28* (2006.01)
*B65D 41/04* (2006.01)

(52) U.S. Cl. ..... 53/485; 53/287; 215/329; 220/300

(58) Field of Classification Search ..... 53/476, 53/484, 485, 490, 285, 287, 317; 215/317, 215/320, 331, 330, 357, 356, 360, 44, 43, 215/316, 243, 237, 358, 337, 318
See application file for complete search history.

(56) References Cited

U.S. PATENT DOCUMENTS

| | | | | |
|---|---|---|---|---|
| 133,518 | A | | 12/1872 | Burnap |
| 563,667 | A | | 7/1896 | Hoffman |
| 911,485 | A | | 2/1909 | Fitzgerald |
| 929,485 | A | | 7/1909 | Plunkett |
| 1,459,589 | A | | 6/1923 | Hoffman |
| 1,499,612 | A | | 7/1924 | Hammer |
| 1,516,046 | A | | 11/1924 | Lee |
| 1,669,579 | A | | 5/1928 | Scofield |
| 1,849,523 | A | | 3/1932 | Hammer |
| 1,858,163 | A | | 5/1932 | De Boissac |
| 2,045,388 | A | | 6/1936 | Guthrie |
| 2,063,157 | A | | 12/1936 | Gray |
| 2,072,873 | A | | 3/1937 | Fusting et al. |
| 2,153,426 | A | | 4/1939 | McNamara et al. |
| 2,168,594 | A | | 8/1939 | Von Till |
| 2,264,792 | A | * | 12/1941 | Gray et al. ..... 215/331 |
| 2,423,295 | A | | 7/1947 | Crabbe et al. |
| 2,733,052 | A | | 1/1956 | Luther |
| 2,822,104 | A | | 2/1958 | Busch |
| 3,101,856 | A | | 8/1963 | Whitman, Jr. |
| 3,110,410 | A | | 11/1963 | Pehr |
| 3,239,112 | A | | 3/1966 | Porcelli ..... 222/541.9 |
| 3,260,422 | A | | 7/1966 | Fillmore et al. ..... 222/485 |

(Continued)

FOREIGN PATENT DOCUMENTS

| | | |
|---|---|---|
| AT | 236822 | 3/1964 |

(Continued)

*Primary Examiner* — Paul R Durand
(74) *Attorney, Agent, or Firm* — Wood, Phillips, Katz, Clark & Mortimer

(57) ABSTRACT

A positive orientation container and closure combination is provided. The container includes at least one flange segment having a front and a back face. The container further includes a gap defined by the front face of one of the flange segments and the back face of one of the flange segments. The closure includes a plurality of collar segments. The closure includes at least one collar segment having an engagement face to establish a positive orientation of the closure at a predetermined position.

2 Claims, 7 Drawing Sheets

U.S. PATENT DOCUMENTS 3,269,617 A 8/1966 Imre ..... 222/541.9
3,339,770 A * 9/1967 Bruno ..... 215/214
3,339,773 A 9/1967 Stull
3,372,834 A 3/1968 Ayotte et al.
3,435,978 A * 4/1969 Wittwer ..... 215/217
3,511,403 A 5/1970 Braun
3,612,324 A 10/1971 Malick
3,716,161 A 2/1973 Julian et al.
3,805,987 A 4/1974 Horvath
3,809,276 A 5/1974 Landen
3,831,797 A 8/1974 Stevens, Jr.
3,910,444 A 10/1975 Foster
3,917,096 A * 11/1975 Hedgewick ..... 215/211
3,942,680 A 3/1976 Seeley et al. ..... 220/324
3,951,289 A 4/1976 Landen
3,954,200 A 5/1976 Willis
3,973,941 A 8/1976 Augeri
3,993,208 A 11/1976 Ostrowsky
4,002,275 A 1/1977 Crowle et al. ..... 222/543
4,007,848 A 2/1977 Snyder
4,022,352 A * 5/1977 Pehr ..... 222/153.14
4,036,385 A 7/1977 Morris
4,049,148 A 9/1977 Suhr et al. ..... 215/214
4,051,974 A 10/1977 Gentile
4,053,078 A * 10/1977 Herr ..... 215/222
4,068,775 A 1/1978 Palmer
4,084,716 A * 4/1978 Bogert ..... 215/217
4,093,096 A 6/1978 Augros
4,098,419 A 7/1978 Virog, Jr. et al.
4,127,221 A 11/1978 Vere
4,134,513 A 1/1979 Mumford
4,144,983 A 3/1979 Pauls et al.
4,159,779 A 7/1979 Hedgewick ..... 215/214
4,177,904 A 12/1979 Planas
4,271,974 A 6/1981 Quinard
4,273,248 A 6/1981 Lehmann
4,280,632 A 7/1981 Yuhara
4,289,248 A 9/1981 Lynn
4,310,101 A 1/1982 Sekine
4,320,844 A * 3/1982 Cooper ..... 215/260
4,364,483 A 12/1982 Golde ..... 215/218
4,365,721 A 12/1982 Montgomery
4,387,821 A 6/1983 Geiger
4,387,822 A 6/1983 Lynn
4,444,327 A 4/1984 Hedgewick ..... 215/211
4,454,965 A 6/1984 Kirk, Jr.
4,456,136 A 6/1984 Pálsson
4,496,066 A 1/1985 Bullock, III ..... 215/320
4,519,518 A 5/1985 Wiles et al.
4,597,501 A 7/1986 Gueret
4,638,918 A 1/1987 Martinez
4,645,096 A 2/1987 Grant
4,662,530 A 5/1987 Goncalves
4,669,624 A * 6/1987 Wiles et al. ..... 215/330
4,682,702 A 7/1987 Gach ..... 222/541.9
4,691,833 A 9/1987 Ahrens
4,711,360 A 12/1987 Ullman ..... 215/235
4,747,498 A 5/1988 Gach
4,763,801 A 8/1988 Nycz
4,763,804 A 8/1988 O'Connell
4,770,308 A 9/1988 Lynn
4,781,311 A 11/1988 Dunning et al.
4,799,597 A 1/1989 Mayes et al.
4,807,768 A 2/1989 Gach ..... 215/216
4,815,616 A 3/1989 Silvenis
4,821,899 A 4/1989 Nyez et al.
4,858,777 A 8/1989 Morel
4,913,299 A 4/1990 Petro
4,936,475 A * 6/1990 Montgomery ..... 215/252
4,940,167 A 7/1990 Fillmore et al. ..... 222/153.09
4,940,168 A 7/1990 Shadwell et al.
4,955,513 A 9/1990 Bennett
4,991,733 A * 2/1991 Marino ..... 215/330
5,133,471 A 7/1992 Almirall
5,141,347 A 8/1992 Fitjer
5,143,234 A 9/1992 Lohrman
5,145,080 A 9/1992 Imbery, Jr.
5,150,803 A 9/1992 Cartellone
5,160,057 A 11/1992 Fitjer
5,169,033 A * 12/1992 Shay ..... 222/153.09
5,184,741 A 2/1993 Chevassus et al.
5,186,344 A 2/1993 Cook
5,213,223 A 5/1993 Minnette ..... 215/216
5,213,225 A * 5/1993 King et al. ..... 215/330
5,279,434 A 1/1994 Aguirrezabal
5,292,020 A 3/1994 Narin
5,411,157 A 5/1995 King et al.
5,454,476 A 10/1995 King et al.
5,533,633 A * 7/1996 King ..... 215/252
5,547,091 A 8/1996 Neveras et al. ..... 215/237
5,588,545 A 12/1996 King
5,676,270 A 10/1997 Roberts
5,690,241 A 11/1997 Montgomery ..... 215/28
5,769,254 A 6/1998 King et al.
5,803,287 A 9/1998 Kusz
5,806,698 A 9/1998 Aguirrezabal
5,927,527 A * 7/1999 Montgomery et al. ..... 215/219
5,944,208 A 8/1999 Gale
5,967,352 A 10/1999 Repp et al. ..... 215/256
5,984,123 A 11/1999 Mogami et al.
5,992,659 A 11/1999 Nofer et al.
5,992,668 A 11/1999 Elliott ..... 220/278
6,056,136 A * 5/2000 Taber et al. ..... 215/252
6,082,565 A * 7/2000 Harrold ..... 215/218
6,112,921 A 9/2000 Robinson ..... 215/216
6,173,853 B1 1/2001 Luch ..... 215/256
6,227,391 B1 5/2001 King ..... 215/307
6,378,713 B2 4/2002 Montgomery ..... 215/222
6,477,443 B2 11/2002 Salgado et al. ..... 700/220
6,848,590 B2 * 2/2005 Brozell et al. ..... 215/220
7,000,792 B2 2/2006 Arai ..... 215/237
7,055,708 B1 * 6/2006 Haffner et al. ..... 215/222
7,621,413 B2 11/2009 Miota et al.
2001/0013523 A1 8/2001 Gross et al. ..... 222/94
2005/0051508 A1 3/2005 Hackmann et al.
2005/0199572 A1 * 9/2005 Brozell ..... 215/218
2005/0205607 A1 9/2005 Hierzer et al. ..... 222/153.1
2007/0181523 A1 8/2007 Jackel

FOREIGN PATENT DOCUMENTS

CA 963845 3/1975
CH 455545 7/1968
DE 4037227 7/1991
DE 29819652 1/1999
DE 102004010845 B3 5/2005
DK 109493 4/1968
EP 0 007 274 1/1980
EP 0 011 575 A1 5/1980
EP 0431 915 A1 6/1991
EP 1452457 A2 9/2004
FR 1560099 2/1969
FR 77.39457 7/1979
FR 90.06234 11/1991
GB 225923 12/1924
GB 2126565 3/1984
JP 06024459 A 2/1994

* cited by examiner

CLOSURE SYSTEM WITH ORIENTATION AND REMOVAL CAPABILITY

CROSS REFERENCE TO RELATED APPLICATION(S)

This application is a divisional of U.S. patent application Ser. No. 11/450,531, filed Jun. 9, 2006.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a package in the form of a combination of a container and a closure for the container. More particularly, the invention relates to a closure and container package that provides positive-orientation of the closure relative to the container, and that permits the closure to be removed.

BACKGROUND OF THE INVENTION AND TECHNICAL PROBLEMS POSED BY THE PRIOR ART

Oftentimes, when closures are placed on containers, it is desirable to have the closure oriented in a specific manner with respect to the container. This may be desired for a number of reasons such as enabling the user to view the front face and/or label of the container as the user manipulates the front of the lid on the closure to open or close the lid. Further it may be desired to have a container and corresponding closure whereby threads are not required to attach the closure to the container. However, it still may be desired to have a positive orientation structure associated with such a container and closure combination.

Positive orientation systems for packages in the form of a container and a closure assembly for the container are generally known in the prior art. For is incorporated herein by reference, discloses a closure assembly that includes a closure body having a closure skirt with one or more recesses on an interior surface of the closure skirt. The closure assembly is adapted to engage a container neck finish that includes a threaded container neck with protuberances formed on a base portion thereof. Each recess is adapted to receive a protuberance. As the closure is rotated and threaded onto the container neck, the closure skirt is initially engaged by and deformed somewhat by the protuberances. Either the container neck or the closure skirt, or both, must be sufficiently resilient to deform as the closure is threaded onto the container neck so as to accommodate relative movement of the protuberance and skirt until the protuberance is received in the recess. When the recesses become aligned with the protuberances, the container skirt or protuberances, or both, return to their undeformed shape, thereby retaining the closure in a predetermined orientation on the container.

It would therefore be desirable to provide a positive orientation system in the form of a closure and container combination that avoid the limitations found in the prior art.

Some conventional orientation systems for closures require the use of relatively expensive automatic capping equipment that is specially designed to apply caps in a predetermined orientation on containers. It would be desirable to provide an improved orientation system that would not require such expensive, specialized equipment. It would also be advantageous if such an improved closure system could accommodate bottles, containers, or packages which have a variety of shapes and that are constructed from a variety of materials. Further, it would be desirable if such an improved system could accommodate efficient, high-quality, large volume manufacturing techniques with a reduced product reject rate to produce a system with consistent operating characteristics.

BRIEF SUMMARY OF THE INVENTION

The benefits and advantages described above are realized by the present invention which provides a package, including a closure and container combination having positive-orientation features.

In a broad sense, the invention comprises a container having an interior, an opening to the interior, and at least one circumferentially oriented flange segment that extends less than 360 degrees, has a starting end defined by a front face, and has a termination end defined by a back face. The invention further comprises a gap defined by the front face of one of the flange segments and the back face of one of the flange segments. Finally, the invention comprises a closure cooperatively associated with the container for closing the opening, the closure comprising a plurality of axially extending collar segments which each has an engagement end. The closure also has a closure orientation structure comprising an engagement face on at least one of the closure collar segments at the engagement end for engaging the front face of one of the container flange segments to establish a positive orientation of the closure at a predetermined position of rotation relative to the container as the closure is rotated relative to the container in an assembly direction.

In one preferred embodiment, the invention provides a positive orientation closure for engaging a container orientation structure on a container having an opening. The closure comprises a covering portion, a plurality of arcuate collar segments, a closure orientation structure, and a closure displacing structure. The covering portion covers the container opening, with the covering portion having a dispensing orifice. The plurality of arcuate collar segments extend axially from the covering portion wherein each collar segment has a distal edge and an engagement end. The closure orientation structure is located on at least one of the collar segments at the engagement end wherein the closure orientation structure comprises an engagement face. The closure displacing structure is located on another of the collar segments wherein the displacing structure extends between the engagement end and the distal edge whereby the displacing structure engages the container orientation structure thereby displaces the closure axially relative to the container as the closure is rotated relative to the container in an assembly direction.

In another preferred embodiment, a method is provided for assembling an orientation container and closure combination. The container includes a neck defining an opening to the container, the neck has a circumference and at least one flange segment that is formed thereon extending along the circumference and that includes a container orientation structure having a front face defining a starting point of one of the flange segments and a back face defining an ending point of one of the flange segments. The closure includes a plurality of collar segments. Each collar segment includes an engagement end and a bead located on a distal end. An engagement face is located on the engagement end of at least one of the collar segments. The method includes the steps of:

placing the closure on the container;

rotating the closure with respect to the container in an assembly direction;

contacting the front face one of the flange segments with the engagement face of the engagement end of one of the collar segments to orient the closure on the container; and providing a downward force on the closure wherein the at least one flange segment contacts the beads on the collar segments to deflect the collar segments radially outwardly so as to pass over the flange segment and wherein the collar segments subsequently return radially so as to position the bead on the collar segments beneath the at least one flange segment.

The novel positive orientation features provided by the invention can easily be provided in closures and containers manufactured by injection molding of thermoplastic materials.

Numerous other advantages and features of the present invention will become readily apparent from the following detailed description of the invention, from the claims, and from the accompanying drawings.

BRIEF DESCRIPTION OF THE DRAWINGS

The accompanying drawings form part of the specification, and like numerals are employed to designate like parts throughout the same.

In the accompanying drawings that form part of the specification, and in which like numerals are employed to designate like parts throughout the same.

DETAILED DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, most of the figures illustrating the invention show a positive orientation system in a closure and container in the typical orientation that it would have when the closure is installed at the top of a container when the container is stored upright on its base, and terms such as upper, lower, horizontal, etc., are used with reference to this position. It will be understood, however, that the positive orientation systems of this invention may be manufactured, stored, transported, used, and sold in an orientation other than the position described.

Similarly, the following description of the assembly and disassembly of the combination of the closure and container refer to the closure being rotated relative to the container. It should be readily understood that this terminology also encompasses the closure being held stationary while the container is rotated, as well as both the container and the closure being rotated.

Furthermore, the figures do not illustrate the entire container structure, but the design, shape and manufacture of such structure is easily understood by those skilled in the art and need not be discussed in the present application. Some of the figures illustrating the preferred embodiment of the container and closure show conventional structural details and features that will be recognized by one skilled in the art. However, a detailed description of such details and features are not necessary for an understanding of the invention, and accordingly, are not herein presented.

Figure 1:
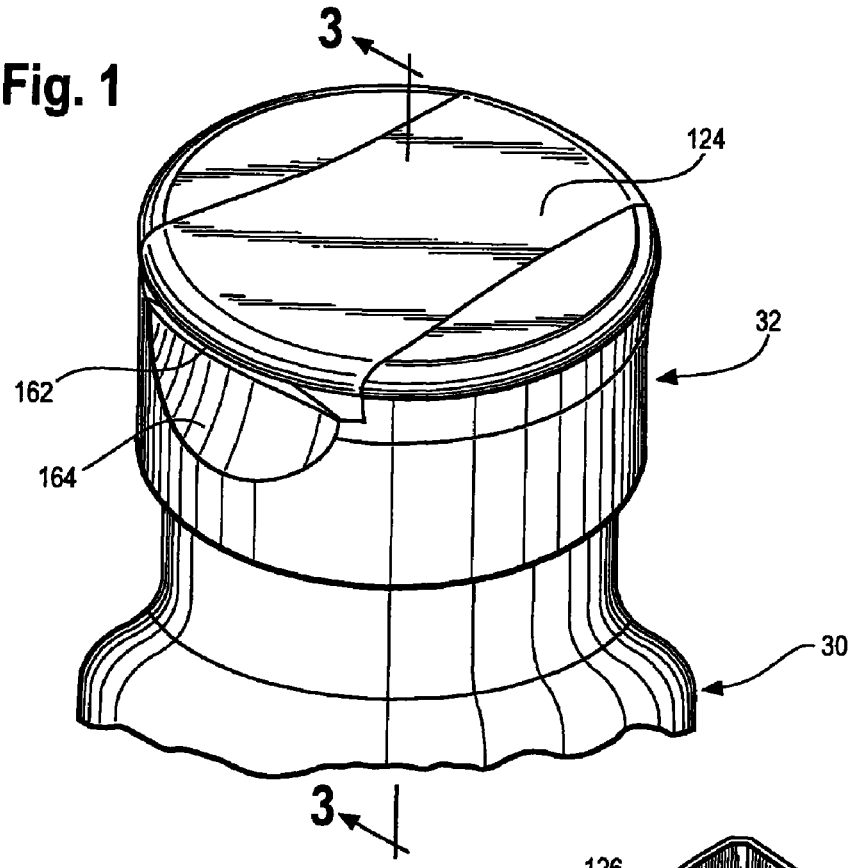
FIG. 1 is a fragmentary perspective view of the top of a container and closure in combination wherein a closure covering portion is in a closed state.
Figure 2:
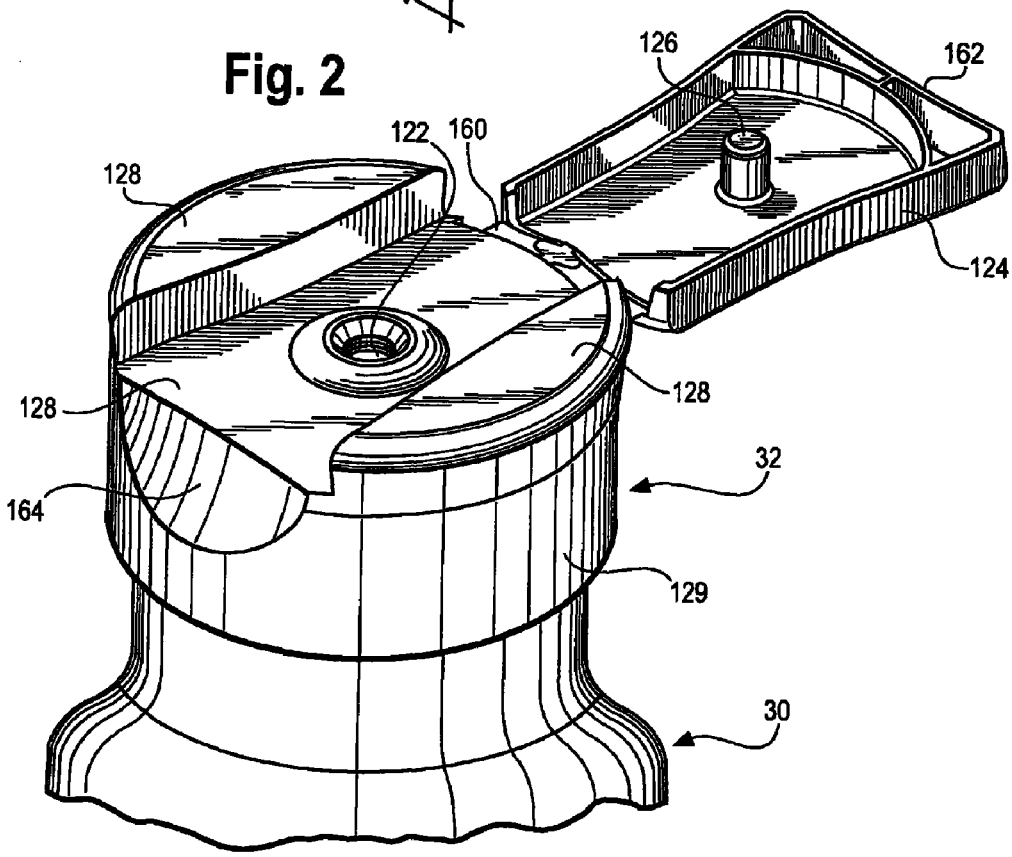
FIG. 2 is a fragmentary view similar to FIG. 1, but in FIG. 2 the closure covering portion is in an open state.

With reference to FIGS. 1-2, a partial view of a container 30 and a closure 32 in combination is shown. The container 30 and closure 32 combination may be utilized to maintain the contents (not shown) of the container 30 within the container 30. The container 30 and closure 32 combination includes positive orientation features as described in the following embodiments and accompanying figures.

Figure 4:
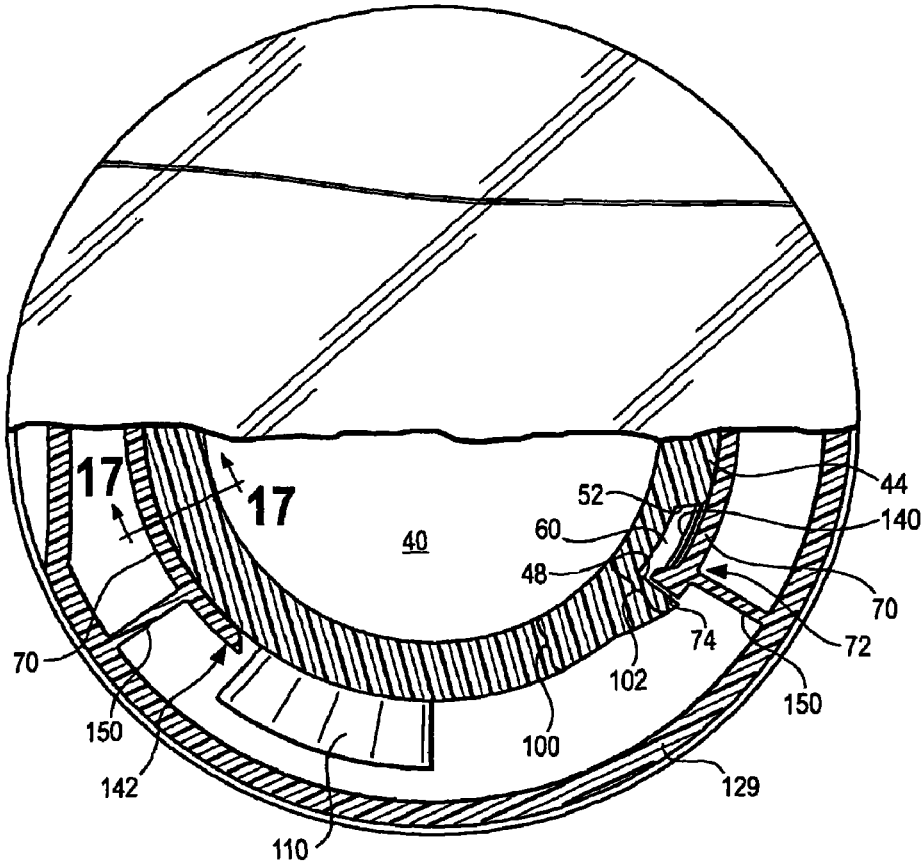
FIG. 4 is a partial cutaway top view taken along line 4-4 of FIG. 3 of the closure with the closure covering portion in the closed state.
Figure 5:
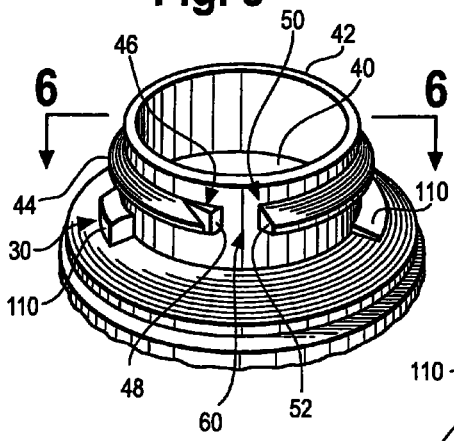
FIG. 5 is a fragmentary perspective view of a portion of the container shown in FIG. 1 with the closure removed to reveal the positive orientation structure on the container.
Figure 6:
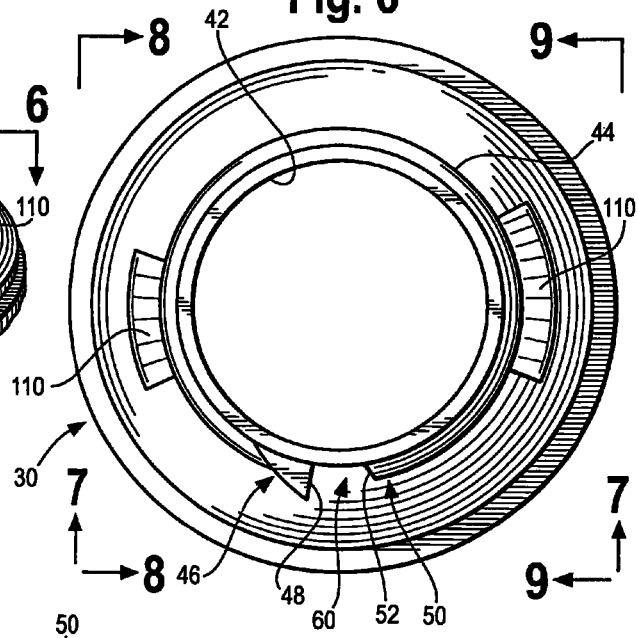
FIG. 6 is a top view taken along line 6-6 of FIG. 5 of the portion of the container having the positive orientation structure arranged thereon.

According to the present invention, and as illustrated in FIG. 5, the container 30 includes an interior 40, an opening 42 to the interior 40, and at least one circumferentially oriented flange segment 44 that extends less than 360 degrees. As shown in FIGS. 5 and 6, the at least one flange segment 44 has a starting end 46 defined by a front face 48 and has a termination end 50 defined by a back face 52. While the embodiment shown in FIGS. 1-21 has only one flange segment 44, it should be understood by those skilled in the art that the container 30 may instead have any number of flange segments 44 with each flange segment 44 having a starting end 46 and a termination end 50.

The container also includes a gap 60 (FIGS. 5 and 6) defined by the front face 48 of one of the flange segments 44 and the back face 52 of one of the flange segments 44. As illustrated in FIG. 6, the gap 60 is defined by the front face 48 and back face 52 of the same flange segment. However, it should be understood by those skilled in the art that the gap 60 may be defined by the front face 48 and back face 52 of different flange segments 44 if the container 30 includes multiple flange segments 44.

Figure 10:
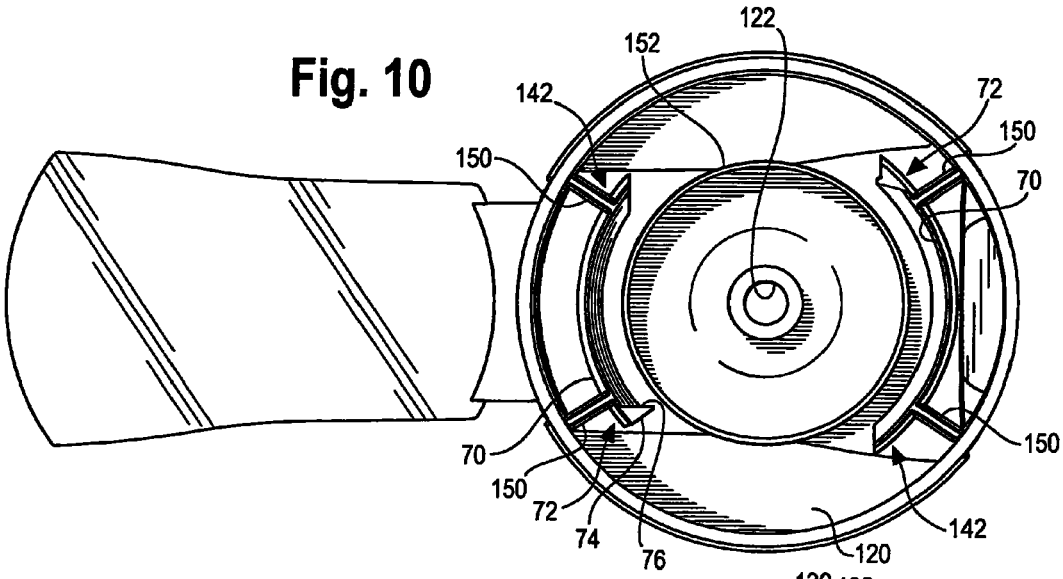
FIG. 10 is a bottom view of the closure illustrated in FIG. 2 after the closure has been removed from the container.
Figure 11:
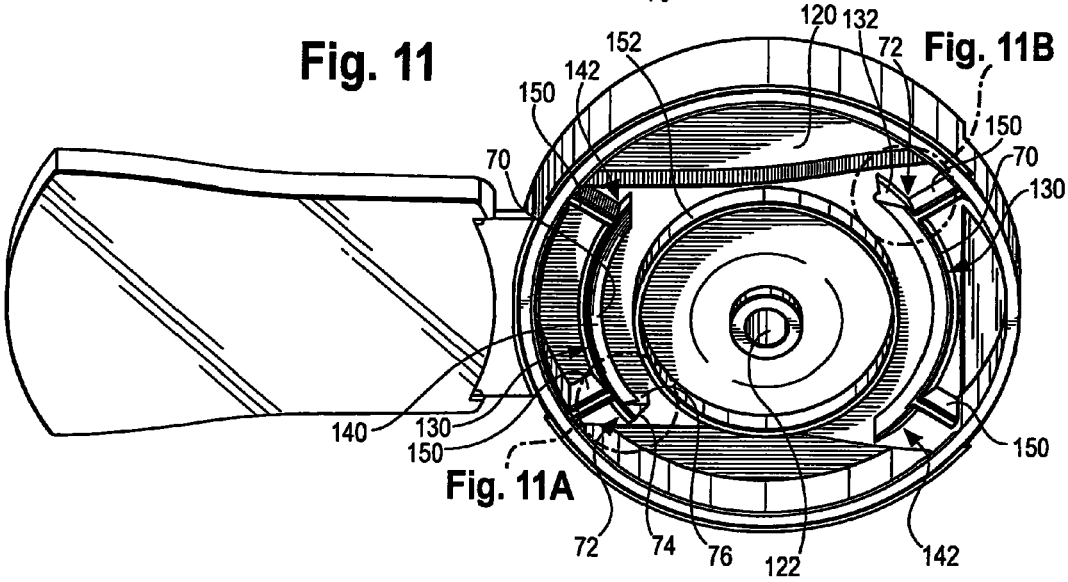
FIG. 11 is a perspective view of the bottom of the closure illustrated in FIG. 10.

The closure 32 is cooperatively associated with the container 30 for closing the opening 42. Referring to FIGS. 10-11B, the closure 32 includes a plurality of axially extending collar segments 70 which each has an engagement end 72. The closure 32 further includes closure orientation structure which comprises an engagement face 74 (FIGS. 10-11A) on at least one of the collar segments 70 at the engagement end 72 for engaging the front face 48 of one of the container flange segments 44 to establish a positive orientation of the closure 32 at a predetermined position of rotation relative to the container 30 as the closure 32 is rotated relative to the container 30 in an assembly direction, illustrated by arrow 80 in FIGS. 12-15. In the preferred embodiment illustrated, the engagement face 74 extends radially inwardly further than the remaining portion of the collar segment 70 as can be seen in FIGS. 4 and 11. The engagement end 72 of at least one collar segment 70 may also optionally include a disengagement face 76 (FIGS. 10, 11, 11A, 19 and 20) that is angled to contact the back face 52 of the gap 60.

Figure 7:
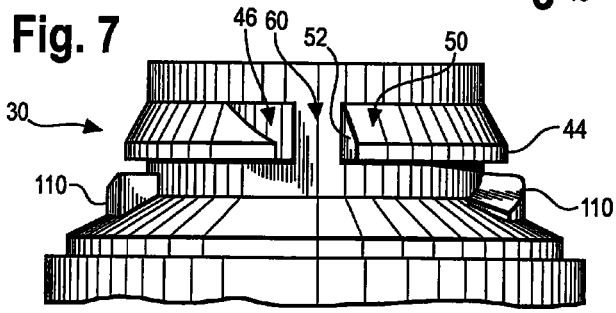
FIG. 7 is a fragmentary, side view of the portion of the container taken along line 7-7 of FIG. 6.
Figure 8:
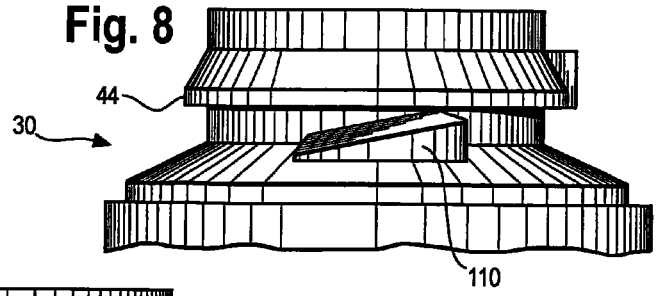
FIG. 8 is a fragmentary, side view of the portion of the container taken along line 8-8 of FIG. 6.
Figure 9:
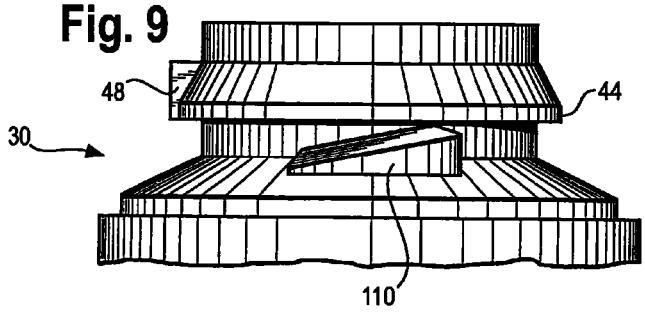
FIG. 9 is a fragmentary, side view of the portion of the container taken along line 9-9 of FIG. 6.
Figure 17:
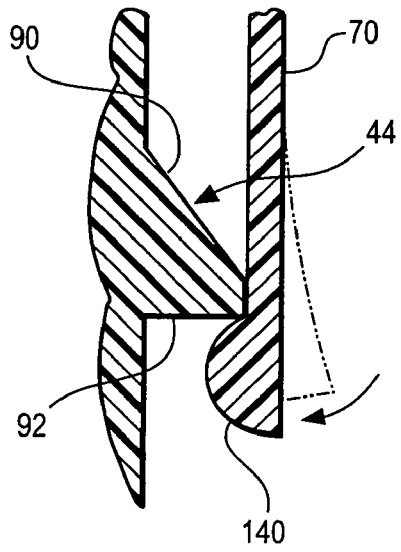
FIG. 17 is a fragmentary, cutaway cross-sectional view taken along line 17-17 of FIG. 4 to show a closure collar segment engaging a container flange segment.

The components of the container 30 and the closure 32 will be described in more detail. Specifically, the container 30, as described above, includes the at least one flange segment 44 and associated faces 48,52. As best seen in FIGS. 7 and 17, the flange segment 44 is positioned such that it will interact with the collar segments 70 to retain the closure 32 on the container 30. As seen in FIG. 17, the flange segment 44 includes a sloped portion 90 and a retaining portion 92. While this figure illustrates one preferred embodiment for the shape of the flange segment 44, it should be readily understood by those skilled in the art that the flange segment 44 may take other shapes as well.

Further, the container includes the gap 60 defined by faces 48,52 of the same or of different flange segments 44. The shape and relative orientation of the faces 48,52 may be varied for different purposes. Specifically, as illustrated, the front face 48 extends substantially axially and radially relative to the container 30 while the back face 52 extends in a generally vertical plane that is oblique to the radius of the container opening 42. The back face 52 slants away from the front face 48 with increasing distance from the center of the container opening 42. container 30. The purpose of the orientation of these structures will be described in more detail regarding the operation of the present invention. However, while the above embodiment illustrates one orientation and shape of the structures, it should be readily understood by those skilled in the art that the orientation and shape of the structures may be varied as desired. For example, the front and back faces 48,52 may extend at substantially the same angle from the container 30. Similarly, the faces 48,52 may extend at different angles from the container 30. Also, the faces 48 and 52 need not be planar, and could be arcuate to some extent.

Figure 20:
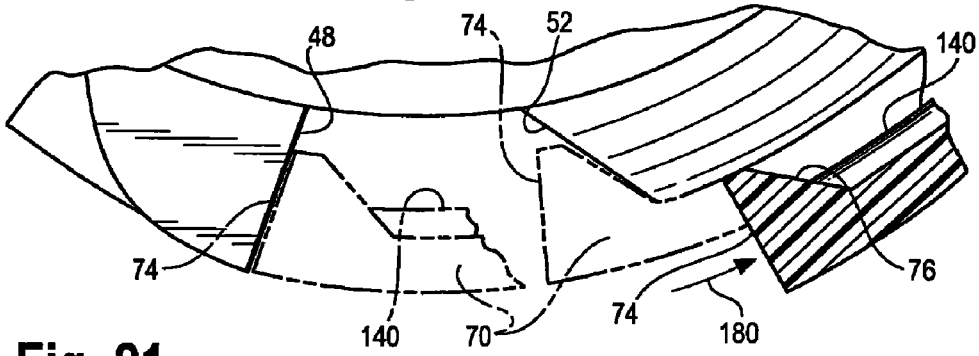
FIG. 20 is a fragmentary, partial cutaway top view of a portion of the container and closure as the closure is rotated further in the disassembly direction.
Figure 21:
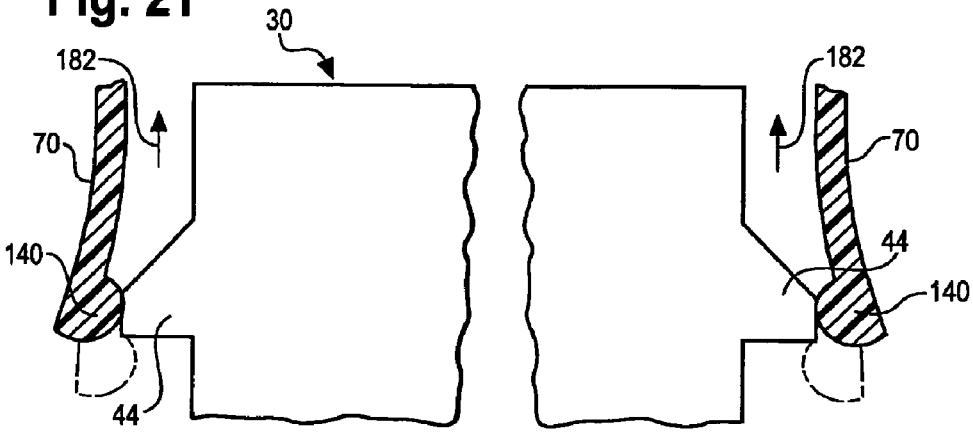
FIG. 21 is a fragmentary, simplified, diagrammatic side elevational view, partially in cross-section, of the closure collar segments disengaging from the container as the closure is removed from the container.

The gap 60 may also include additional features regarding the shape of the front face 48. Generally, in the preferred form shown in FIG. 4, the container wall and the flange segment 44 have a combined thickness 100 which is uniform over most of the length of the segment 44 around the container 30. However, the front face 48 that defines the gap 60 extends outwardly a further distance from the center of the container 30 so that the container wall and the flange segment 44 have a maximum thickness 102 (FIG. 4) at the front face 48. As seen in FIG. 4, the face 48 thus extends outwardly further than the rest of flange segment 44. This configuration is one preferred embodiment because the front face 48 can engage the closure collar segment engagement face 74 (FIG. 20). Having the front face 48 extend outwardly a greater distance than the remainder of the flange segment 44 increases the likelihood that the engagement face 74 will not pass over the front face 48. While the embodiment shown in FIG. 4 has the front face 48 defining the gap 60 as extending outwardly a greater radial distance than the rest of flange segment 44, it should be readily understood by those skilled in the art that the front face 48 may extend outwardly a lesser or greater amount.

The container 30 may also include additional features. Specifically, the container 30 may include at least one ramp 110, but multiple ramps, such as illustrated in FIGS. 5-9, are also possible. It should be understood that the container may include any number of ramps 110, or no ramps 110. However, in a preferred embodiment, there are an equal number of ramps 110 on the container as there collar segments 70 on the corresponding closure 32. In a highly preferred embodiment, there are two ramps 110 (as illustrated in the Figures).

Figure 3:
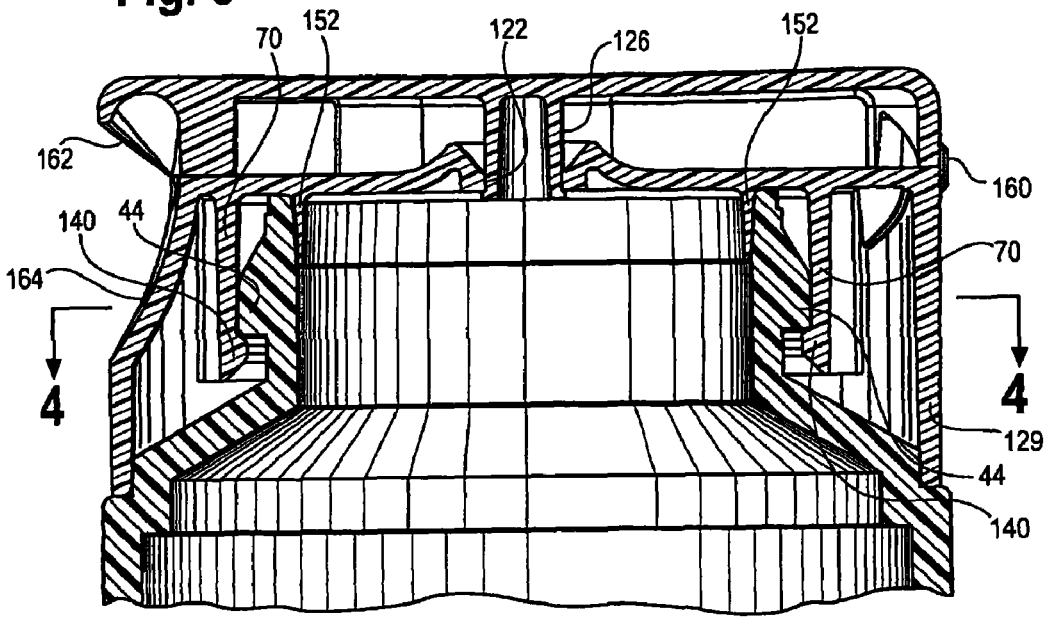
FIG. 3 is a cross-sectional view taken along line 3-3 of FIG. 1 of the closure and a portion of the container.

The structure of the closure 32 will now be discussed in more detail. As described above, the closure 32 includes a plurality of axially extending collar segments 70. In one preferred embodiment (as illustrated), these collar segments 70 extend from a covering portion 120 whereby the covering portion 120 is used for covering the opening 42 of the container 30. The covering portion 120 further includes a dispensing orifice 122 (FIG. 2) for dispensing the contents of the container 30. Referring to FIG. 2, the orifice 122 may be closed using a lid 124 wherein the lid 124 may optionally include a spud 126 to seal the orifice 122 as shown in FIG. 3. The covering portion 120 may further include a top portion 128 and a side portion 129. The side portion 129 may sometimes be referred to as a skirt by those skilled in the art.

The closure collar segments 70 may be shaped and oriented to interact with the corresponding container 30. For example, referring to FIGS. 10 and 11, it can be seen that the collar segments 70 are arcuate to interact with the generally circular shape of the container 30 and the flange segment 44. It should be understood by those skilled in the art that the collar segments may vary in the shape of the arc as well as the general shape and placement of the segments 70 as required to correspond to the container 30.

In addition to the engagement end 72, all but one of the collar segments 70 further include a distal edge 130 (FIGS.

11A and 11B) and a displacing structure 132. In the preferred form, the displacing structure 132 is a slanted surface that extends between the vertical engagement end 72 and the horizontal, bottom distal edge 130. The displacing structure 132 can engage the container 32 to thereby displace the closure 32 axially relative to the container 30 as the closure 32 is rotated relative to the container 30 in the assembly direction 80. At least one collar segment 70 includes the engagement end 72 and engagement face 74, while optionally, at least one collar segment 70 may include the displacing structure 132, as illustrated in FIGS. 11-11B. However, multiple collar segments may include an engagement face 74 and multiple collar segments may include the displacing structure 132.

Figure 11A:
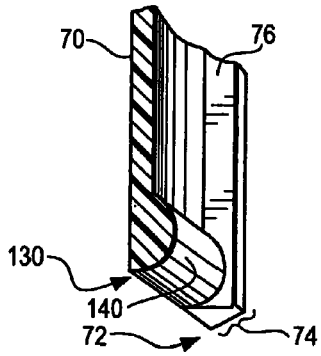
FIG. 11A is an enlarged fragmentary, cutaway view of an engagement end of a collar segment illustrated in FIG. 11.
Figure 11B:
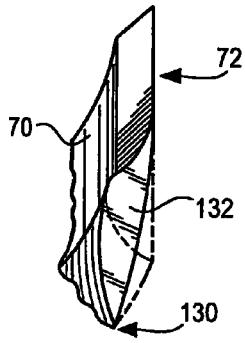
FIG. 11B is an enlarged fragmentary, cutaway view of an engagement end of another collar segment illustrated in FIG. 11.
Figure 12:
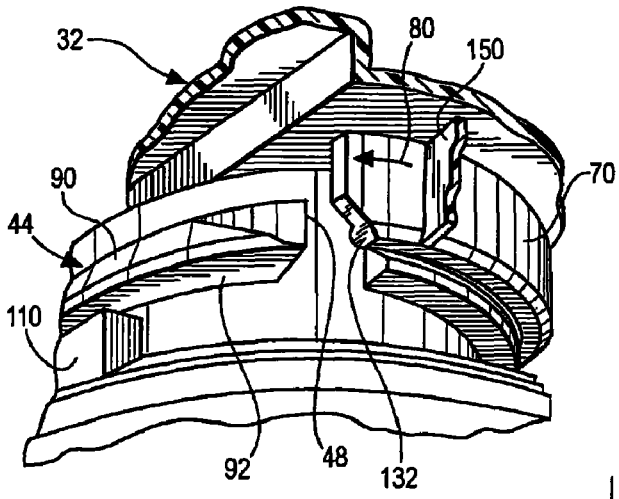
FIG. 12 is a fragmentary, partial cutaway view of the container and closure as the closure is rotated in an assembly direction
Figure 13:
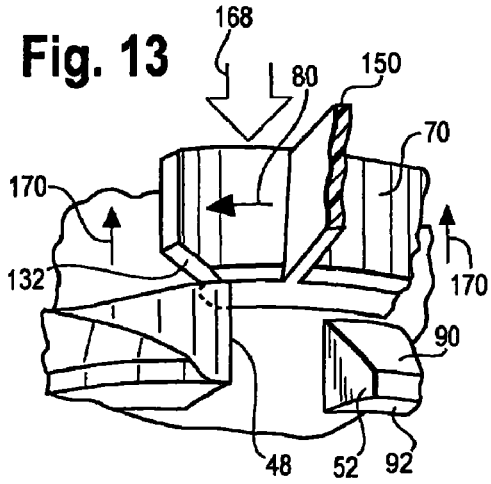
FIG. 13 is a fragmentary, partial cutaway view of the container and closure as the closure is rotated in the assembly direction whereby a closure displacing structure displaces the closure relative to the container.

The collar segments 70 may further include a bead 140, as best seen in FIGS. 3 and 11A. The bead 140 may be sized and oriented to cooperate with the at least one flange segment 44 located on the container 30 to retain the closure 32 upon the container 30. In a preferred embodiment, the bead 140 has an arcuate cross-sectional shape (FIG. 11A). Other shapes are also contemplated. For example, the bead 140 may have more of a square or triangular cross-sectional shape.

As can be seen in FIGS. 4, 11, and 11A, the bead 140 at the bottom of the collar segment 70 does not extend radially inwardly as far as the engagement face 74 in the preferred embodiment illustrated.

Optionally, the collar segments 70 may also include a disengagement end 142. Generally, the disengagement end 142 may be located on an opposite end relative to the engagement end 72, as illustrated in FIG. 10. The disengagement end 142 may take a variety of shapes as well. The bottom corners of the disengagement end 142 can engage the ramps 110 on the container 30 during disassembly as described in detail hereinafter.

The closure 32 may also contain additional details. For instance, the closure may include rigidizing struts 150. The rigidizing struts 150 may be connected to the collar segments 70 to provide further rigidity and resist deformation of the collar segments 70. Further, the closure 32 may include a plug seal 152. The plug seal 152, or some other type of conventional or special seal, may be positioned and shaped to fit inside the opening 42 of the container. The plug seal 152 may be utilized to further aid in preventing the contents of the container 30 from leaking from the container 30.

Additionally, the closure 32 may also include a hinge 160 (FIGS. 2 and 3) to connect the lid 124 to the closure 32 as well as a thumb lift 162 and a thumb recess 164. The hinge 160 may take any form, but in a preferred embodiment, the hinge 160 is a thin film hinge permitting the lid to move between an open position and a closed position. The thumb lift 162 and thumb recess 164 provide an easily accessible location for a user to apply force to the lid to move the lid from the closed position to the open position.

When fully assembled, the container 30 and closure 32 are oriented as illustrated in FIGS. 3 and 4 wherein the collar segments 70 have passed over and engaged the flange segment 44, and wherein the collar segment engagement face 74 has entered the gap 60 to confront (and possibly contact) the front face 48 of the container flange segment 44.

The assembly of the container 30 and closure 32 combination will be discussed in more detail now referring to FIGS. 12-16. Generally, assembly of the combination begins by placing the closure 32 (FIG. 12) on the container 30. The closure 32 is then be rotated in the assembly direction 80 while the container 30 is restrained from rotating. As the closure 32 is rotated (either manually or more typically by an automatic capping machine), the closure 32 is also subjected to a small, continuously applied, axially downward force (a first force represented in FIG. 13 by arrow 168). This forces the closure 32 lightly against the container flange segment 44.

There are two possible ways in which the assembly process could continue. A first way is next discussed in detail. Specifically, as the closure 32 is rotated in the assembly direction, the collar segment engagement face 74 will eventually be rotated to the gap 60, and confront the upper portion of the front face 48 of the container flange segment 44.

Because the bottom end corner of the closure collar engagement face 74 projects radially inwardly farther than the collar segment bead 140 (see FIGS. 4 and 11A), the upper surface 90 of the container flange segment 44 is contacted by bottom end corner edge of the face 74 instead of by the adjacent trailing portion of the collar segment bead 140. Thus, until the closure collar engagement face 74 is rotated over the gap 60, the inner bottom corner or tip of the radially inwardly projecting engagement face 74 rides on the upper surface 90 container flange segment 44. At that point, the bottom inner end corner edge of the face 74 is free to be forced downwardly slightly into the gap 60 (by the small, first downward force (represented by arrow 168 in FIG. 13) that is applied to the closure (typically by an automatic capping machine)). Thus, the closure 32 will be forced downwardly slightly until the larger diameter collar bead 140 (that trails circumferentially from the faces 74 and 76) engages the upper surface 90 of the container flange segment 44. As the closure 32 continues to be rotated (manually, or more typically by an automatic capping machine), the closure engagement face 74 moves completely across the gap 60 and engages the front face 48 of the container flange segment 44 to prevent further rotation of the closure 32. If a conventional automatic capping machine is employed, the clutch in the machine will prevent excess torque from being applied to the closure 32 which is now in the final, desired position of rotation on the container 30 as established by the engagement of the closure collar engagement face 74 with the container flange segment front face 48. The cessation of closure rotation is sensed by the automatic capping machine, and that provides a signal to the machine to apply a greater downward force (represented by the arrow 169 in FIG. 16). If the closure 32 is being manually applied, the person will sense when it is no longer possible to rotate the closure 32 further in the assembly direction. The person will then apply a greater downward force. In any event, sufficient downward force is applied (either manually or by an automatic capping machine) so that (1) the closure collar segments 70 deflect radially outwardly so as to pass over the container flange segment 44 (FIG. 17), and (2) the collar segments 70 subsequently return to locate the beads 140 of the collar segments 70 beneath the at least one flange segment 44.

Generally, if the assembly process is automated, the capping machine assembling the combination will apply a first downwardly directed force of a predetermined magnitude, (indicated by arrow 168 in FIG. 13) to maintain the closure 32 on the container 30 while rotating the closure 32 in the assembly direction 80. Once the closure collar engagement face 74 contacts the container flange segment front face 48 (FIG. 15) to prevent further rotation of the closure, the machine will receive a signal (in response to the cessation of rotation) that causes the machine to apply a second, greater downward force (indicated by arrow 169 in FIG. 16) to deflect the collar segments 70 outwardly to pass over the at least one flange segment 44 as shown in FIG. 17.

In the second situation or way in which the closure assembly process continues, the rotation of the closure 32 brings an engagement end 72 of a collar segment 70 that does not have an engagement face 74 to the gap 60 first before the engagement face 74 of the other collar segment reaches the gap 60. In this situation, the collar segment 70 without the face 74 preferably instead may include the displacing structure 132 to engage the front face 48. The displacing structure 132 is angled to permit it to engage the upper edge of the container flange segment front face 48 and cam the closure 32 slightly upwardly (indicated by arrow 170 in FIG. 13) as may be necessary so that the trailing portion of the collar segment 70 can readily pass over front face 48 and continue rotating This is necessary because, if the structure 132 could not rotate past the front face 48 in the assembly direction, the closure 32 would not have the proper orientation (which is defined by engagement of the front face 48 with the engagement face 74).

Figure 14:
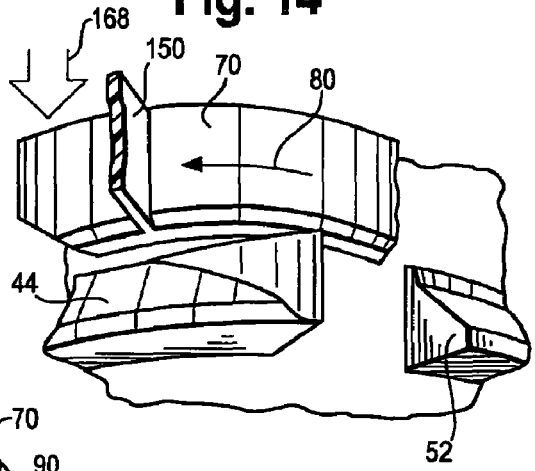
FIG. 14 is a fragmentary, partial cutaway view of the container and closure as the closure is further rotated in the assembly direction past the orientation in FIG. 13.
Figure 15:
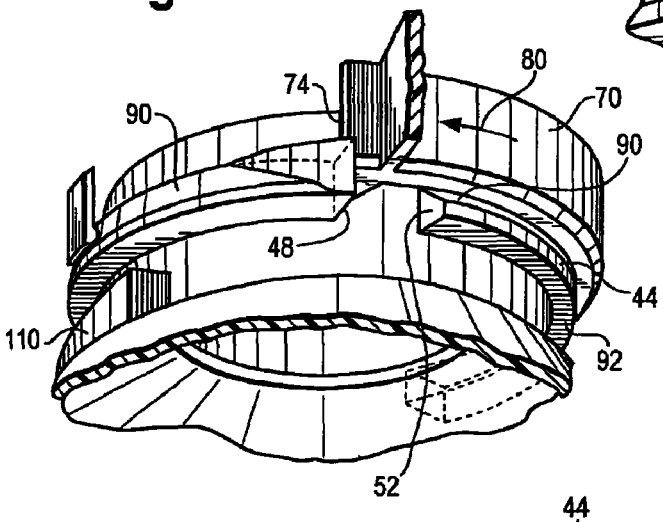
FIG. 15 is a fragmentary, partial cutaway view of the container and closure as the closure is rotated in the assembly direction whereby an engagement face engages a front face of a container flange segment.
Figure 16:
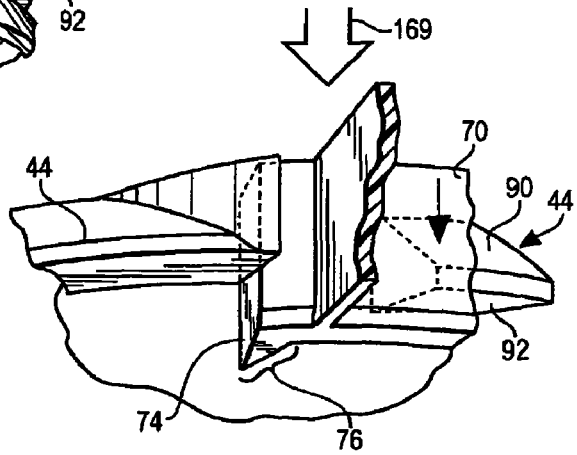
FIG. 16 is a fragmentary, partial cutaway view of the container and closure as the closure is displaced in a generally downward direction by an external force.

As the rotating closure carries the displacement structure 132 past the front face 48, the trailing portion of the collar segment 70 continues past the front face 48 as illustrated in FIG. 14. Preferably, the above discussed action of the displacement structure 132 occurs for each collar segment 70 that does not contain an engagement face 74. In the illustrated preferred embodiment, there is only one collar segment 70 with an engaging face 74, and only one collar segment 70 with a displacement structure 132. However, it should be understood that the closure 32 may have collar segments with more than one engagement face 74 if it is acceptable to orient the closure in more than one position on the container 30. In an alternate embodiment, once any one of a plurality of engagement faces 74 enters the gap 60 and/or contacts the front face 48, the closure 32 may be forced downwardly to engage the collar segments 70 and the at least one flange segment 44 as discussed above and illustrated in FIG. 16.

From the above description, it should be understood by those skilled in the art that the structures may be modified in shape and orientation to accomplish the same function without departing from the scope of the present invention. For example, in the illustrated preferred embodiment, the closure collar segment bead 140 has an arcuate engaging surface to assist the collar segments 70 in deflecting radially outwardly and subsequently return radially inwardly. Other shapes could be employed. Similarly, in the illustrated preferred embodiment, the container front face 48 and the closure engagement face 74 extend substantially radially from the center of the container such that the structures readily engage one another and retain one another with sufficient force. It should be understood that these structure may be modified and still conform to the present invention.

Figure 19:
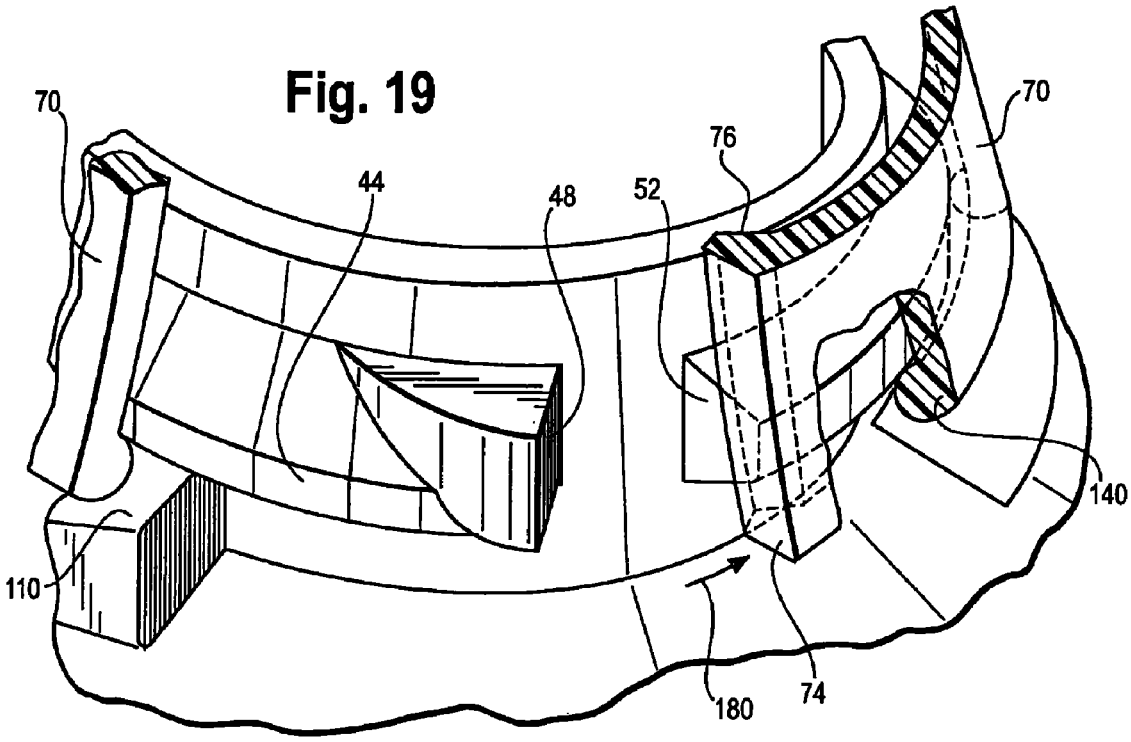
FIG. 19 is a fragmentary, partial cutaway view of a portion of the container and closure as the closure is rotated in a disassembly direction.

While the present invention includes structures and features that provide a positive orientation of the container 30 and closure 32, the present invention also provides structures and features for disassembling the combination. As discussed above, at least one collar segment 70 may include a disengagement face 76 (FIGS. 11 and 20) located on the engagement end 72. The disengagement face 76 may be utilized to contact the back face 52 of the container flange segment 44 at the gap 60 as the closure 32 is rotated in a disassembly direction 180 as illustrated in FIGS. 19 and 20. The disengagement face 76 and the back face 52 may be angled to facilitate the two structures sliding past one another. As the disengagement face 76 slides past the back face 52, the collar segment 70 is deflected radially outwardly thereby permitting the bead 140 to more easily pass over the flange segment 44. A user wishing to disassemble the combination may then apply an upwardly directed force, indicated by arrow 182 in FIG. 21, to remove the closure 32 from the container 30.

A user removing a conventional threaded closure from a threaded container does not have to consciously apply an upwardly directed force as the container is rotated in the unthreading direction. With the present invention (which has no threads), a user may be unaware that an upwardly directed force is necessary to disassemble the combination. Thus it may be desirable to provide a further optional feature to assist the user in removing the closure. Specifically, the ramps 110 may be utilized to drive the closure 32 in a upward direction as the closure is rotated in the disassembly direction. More specifically, with reference to FIG. 18, the disengagement end 142 of one of the collar segments 70 engages the ramps 110 causing the collar segments 70 and the closure 32 to move upward as the closure is rotated in the disassembly direction 180.

Figure 18:
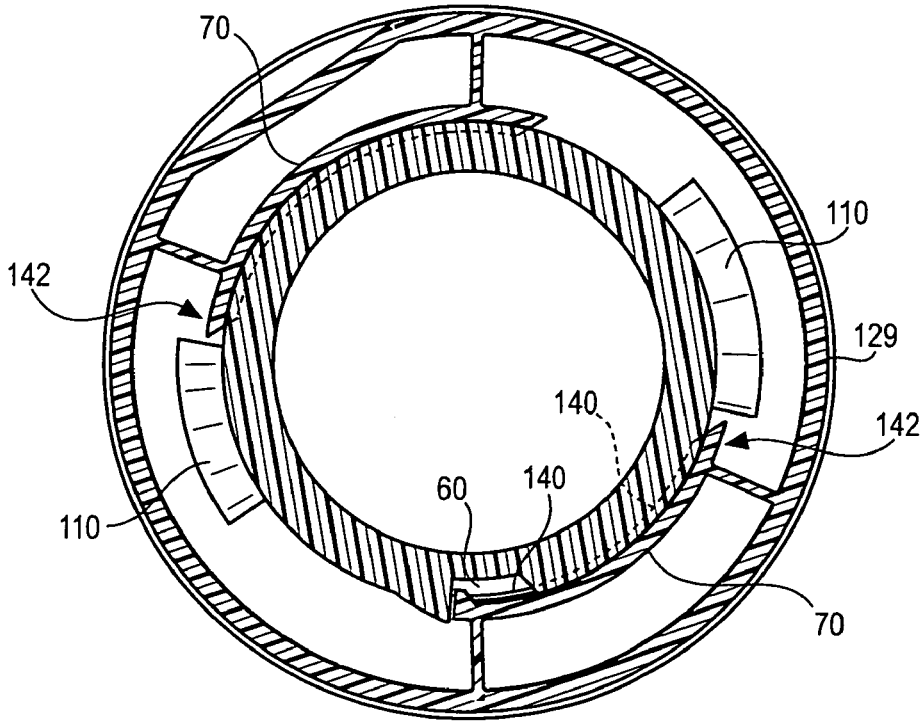
FIG. 18 is a fragmentary, top cross-sectional view taken along line 4-4 of FIG. 3 of the container and closure oriented thereon.

The ramps 110 may be positioned on container 30 such that they are adjacent the disengagement ends 142 of the collar segments 70 when the combination is fully assembled, as illustrated in FIG. 18. In this orientation, once the combination has started rotation in the disassembly direction, the closure 32 is forced upward, thereby providing feedback to the user indicating that additional upward force may be necessary to disengage the closure 32 from the container 30.

The container 30 and closure 32, including the cooperating structure in each, may be manufactured by any means understood by those skilled in the art. However, in a preferred embodiment, the container 30 and closure 32 are manufactured by injection molding.

It will be readily apparent from the foregoing detailed description of the invention and from the illustrations thereof that numerous variations and modifications may be effected without departing from the true spirit and scope of the novel concepts and principles of this invention.

What is claimed is:

1. A method of assembling an orientation container and an unthreaded closure, the container including an unthreaded neck defining an opening to the container, the neck having a circumference and at least one flange segment that (a) is defined thereon extending along a portion of the circumference, and that (b) includes a container orientation structure having a front face defining a starting point of one of the flange segments and a back face defining an ending point of one of the flange segments whereby said front face and back face define between them a gap that is open in opposite axial directions as well as radially, the closure including a plurality of collar segments, at least one collar segment including (a) a distal edge, and (b) a radially inwardly extending bead located at the distal edge, the closure having at least one collar segment that includes (a) an engagement end, and (b) an engagement face located on said engagement end, the method comprising the steps of:

placing the closure on the container;

rotating the closure with respect to the container in an assembly direction;

positioning said collar segment engagement face in said gap and contacting the container orientation structure front face of the at least one flange segment of the container neck with said engagement face of the collar segment to orient the closure on the container; and providing a downward force on the closure wherein the at least one flange segment of the container neck is contacted by said collar segment bead to deflect the collar segment radially outwardly so as to pass over the at least one flange segment of the container neck and wherein the collar segment subsequently returns radially inwardly so as to position the collar segment bead beneath the at least one flange segment of the container neck.

2. The method of claim 1 further comprising the step of contacting a closure displacing structure located at said collar segment engagement end with the container orientation structure and thereby temporarily displacing at least a portion of the closure axially outward relative to the container as the closure is rotated in the assembly direction.

* * * * *